US008485528B2

(12) United States Patent
Eller

(10) Patent No.: US 8,485,528 B2
(45) Date of Patent: Jul. 16, 2013

(54) WAGERING GAME

(75) Inventor: Carl Lee Eller, Minneapolis, MN (US)

(73) Assignee: Moose #81, LLC, Minneapolis, MN (US)

( * ) Notice: Subject to any disclaimer, the term of this patent is extended or adjusted under 35 U.S.C. 154(b) by 209 days.

(21) Appl. No.: 13/090,890

(22) Filed: Apr. 20, 2011

(65) Prior Publication Data

US 2011/0260401 A1 Oct. 27, 2011

Related U.S. Application Data

(60) Provisional application No. 61/326,296, filed on Apr. 21, 2010.

(51) Int. Cl.
*A63F 1/00* (2006.01)

(52) U.S. Cl.
USPC ..... 273/292; 463/14

(58) Field of Classification Search
USPC ..... 273/292
See application file for complete search history.

(56) References Cited

U.S. PATENT DOCUMENTS 5,382,025 A * 1/1995 Sklansky et al. ..... 273/292

* cited by examiner

*Primary Examiner* — Michael Dennis
(74) *Attorney, Agent, or Firm* — Winthrop & Weinstine, P.A.

(57) ABSTRACT

A wagering game is disclosed. In one embodiment, the wagering game is a poker-style game in which players may designate their hands as predicted winning hands according to a predetermined standard and players may alternatively designate their hands as qualifying hands entitled to at least a portion of the wagers at stake according to an alternative standard, in which a qualifying hand is awarded at least a portion of the wagers at stake unless the winning hand is a predicted winning hand. In another embodiment, the wagering game is a poker-style game in combination with a lottery-style game in which players may win the poker-style game according to a predetermined standard and players may also win the lottery-style game according to a jackpot standard.

6 Claims, No Drawings

WAGERING GAME

BACKGROUND

1. Field of the Invention

The invention pertains to the field of wagering games and games of chance.

2. Background Art

Wagering games and games of chance come in many varieties and can be categorized in many ways. At one end of a spectrum are somewhat pure games of chance such as lotteries, bingo, and the like in which outcomes are generally immune to the influence of any applied skill. Next are wagering games based upon outcomes of contested events, such as wagering on horse races, dog races, and even mainstream professional and college sporting events. While these wagering games are in one sense pure chance, in another sense, research into the history and skill of the event participants and the contest conditions could provide an advantage to a person wagering on the outcome, introducing a skill element to these games.

A popular genre of wagering games and games of chance are poker card games. There are numerous types of poker which themselves fall along different points of the spectrum of chance and skill. Straight poker, in which each player receives five cards face down without the opportunity to draw or exchange cards, is largely a game of chance and bluffing. Open or stud forms of poker, in which some of a player's cards are face up, are also a games of chance and bluffing, although each player has access to more information about a competing player's hand. In contrast to these, draw forms of poker admit of more skill and strategy than straight and open forms, as a player is typically allowed to change the composition of his hand in the course of play by discarding some cards and receiving new cards.

The continuing popularity of wagering games and games of chance, from poker to lotteries, offers opportunities for new games of chance, wagering, bluffing and skill. It is against this background that Mr. Carl Eller has invented the present wagering game.

SUMMARY

One embodiment of the present wagering game comprises a poker-style game in combination with a lottery-style game. The game utilizes two pots into which players place their wagers. A first pot holds the wagers of players built up through any variety of ante wagers and wagers made at intervals throughout a deal of the poker-style game. The first pot may be won at the end of the deal by a player having a winning hand according to a predetermined standard for ranking of hands. A second pot holds the wagers of players built up through ante wagers made over the course of a series of deals of play of the poker-style game. The second pot or a portion of the second pot may be won by a player having a jackpot hand at the end of a deal according to a predetermined jackpot standard.

In an alternative embodiment, players of a poker-style game are allowed to designate that their playing hands are either qualifying hands according to a qualifying standard or predicted winning hands. In this embodiment, a player having a qualifying hand is entitled to a portion of the wagers at stake provided that the winning hand has not been designated as a predicted winning hand. If the winning hand is a predicted winning hand, then any player with a qualifying hand is not entitled to a portion of the wagers at stake, or may be entitled to a reduced portion of the wagers at stake. Phrased differently, the qualifying standard provides an alternative method for a player to win a portion of a pot of wagers, where that player would not otherwise be eligible. It is a sort of "back door" or shortcut to winning a share of the pot. In contrast, wagering that a hand is a predicted winning hand is like purchasing an insurance policy against losing a portion of the pot of wagers through this back door or shortcut.

The wagering game may be played with or without a dealer playing a hand on behalf of a house or sponsor. This and other embodiments of the present wagering game are described in greater detail below.

DETAILED DESCRIPTION

The present wagering game has several variants, forms, or embodiments. In a first form, a poker-style game is combined with a lottery-style game. In a second form, a poker-style game is improved by allowing a unique method of winning a portion of the wagers at stake. These two forms may be played as separate games or may be combined into a single game. All embodiments of the game may be played by two or more players using one or more decks of conventional playing cards, although the game may be adapted for play by a single player on a computer or multiple players on one or more computers. The game may also be played in a formal setting with a professional dealer provided by a casino, house, or sponsor, or the game may be played recreationally without a professional dealer. In embodiments having a professional dealer, the dealer may play a hand on behalf of the house or sponsor against which all remaining players play, or the dealer may not play a hand and simply facilitate game play between the players.

In embodiments combining a poker-style game with a lottery-style game, the poker-style game may be any poker-style game. The poker-style game proceeds conventionally with successive deals wherein each deal commences with a different player in a predetermined order. In games without a professional dealer, players may take turns acting as dealer with each new deal. In games with a professional dealer, a button or other device may be placed on the table in front of a player according to a predetermined order to designate that player's position as the "dealer" position for a particular deal, with game play typically commencing with the player to the left of the player designated with the dealer button and rotating to the left, or clockwise around a table. Embodiments where the dealer plays a hand on behalf of the house or sponsor are described further below.

In embodiments where a dealer does not play a hand on behalf of the sponsor or house, the poker-style game utilizes a first pot, which may be called a game pot, into which players place wagers. Prior to a deal, all players wishing to play in that particular deal must make an ante wager, or simply "ante," prior to the dealer dealing any card. The ante wager is the same for all players, and may be a fixed amount for each deal, may increase with successive deals or after a predetermined number of successive deals, may depend upon the number of players at the table, or may otherwise be set by rule, house, dealer, or by agreement of the players.

In any given deal, players may make additional wagers at predetermined intervals. A wager made by any player must be met by any other player desiring to remain active in that particular deal. If a player does not wish to meet, or "call," a wager made by another player, he or she must fold his or her hand. A player who folds forfeits his or her ability to participate in a showdown at the end of the deal and to obtain all or any portion of the first pot.

If at least two players remain active at the end of a deal, after all players have met any outstanding wagers such that each player has wagered equal amounts, the hands of the active players enter into a showdown in which a winning hand is determined according to a predetermined ranking standard. While this ranking standard may vary, one conventional poker ranking standard that may be used ranks hands as follows: (1) straight flush, (2) four of a kind, (3) full house, (4) flush, (5) straight, (6) three of a kind, (7) two pairs, (8) pair, and (9) high card. This standard typically ranks a hand according to the combination of five cards in the hand that achieves the highest rank. In games using multiple decks of cards, a hand having five of a kind ranks higher than any straight flush. Further, hands may be further ranked within each of these categories such that if two competing hands fall within the same rank, the higher ranking hand is the one having cards with higher values. By way of example and not limitation, a hand having four of a kind comprised of four sixes ranks higher than a hand having four of a kind comprised of four threes. A conventional ranking standard in this regard ranks playing card values from highest to lowest as Ace, King, Queen, Jack, Ten, Nine, Eight, Seven, Six, Five, Four, Three, and Two. For purposes of straights, Aces may be high or low, but when ranking pairs, three of a kind, full houses, or four or five of a kind, Aces always rank high. It is possible that two or more hands may tie as winning hands. In embodiments where players play against each other and not against a house, the winning hand, or, in the case of a tie, the winning hands, are awarded the contents of the first pot at the end of the deal. In the case of ties, the winning hands divide the first pot equally.

In one embodiment, the poker-style game may be played where, after the ante, the dealer deals one card face down to each player, then one card face up in a common area. The dealer may then permit a round of wagering, after which the dealer alternates dealing single cards face down to any players who have not folded, with dealing a single card face up in the common area. The dealer may permit wagering intervals after dealing a round of cards face down to each remaining player or after dealing a single card face up in the common area or both. These steps may be repeated until a predetermined number of cards are dealt face down to each player and face up in the common area. Once the predetermined number of face down and face up cards are dealt, the dealer may permit a final round of wagering before the showdown. In the event that at any point during the poker-style game all players but one fold their hands, then the last player in the deal wins the first pot for that deal. In one exemplary embodiment in which each player's hand comprises a total of eight cards, including four face down cards in his or her hand and four face up cards in a common area, after the ante, there may be three rounds of betting: first, after two face down and two face up cards are dealt; second, after a third face down and third face up cards are dealt; and third, after a fourth face down and fourth face up cards are dealt. Alternatively, in such an embodiment, there could be up to eight rounds of betting—one after each card is dealt, whether face down or face up. The number of rounds of betting utilized in any embodiment may be determined beforehand by the house, dealer, or agreement of the players, depending upon the characteristics desired for the particular game. Games with fewer rounds of betting play faster with less overall risk to the players. Games with more rounds of betting generally take longer to play and tend to increase the risk to the players.

If more than one player remains active after all wagering is complete for the deal, then those players reveal any face down or "hole" cards in their possession. In embodiments where the deal includes one or more cards face up in the common area, a player's hand consists of any face down cards dealt to the player along with all of the face up cards in the common area. In some embodiments, the total cards in each player's hand may be more than five cards. At the showdown, the rank of the player's hand is determined to be the five cards in the player's hand that rank highest out of all possible five card combinations that the hand can produce according to the predetermined ranking standard. In embodiments where each player's hand consists of fewer than five cards, then all cards in a player's hand may be used to rank his or her hand according to the predetermined ranking standard. In one exemplary embodiment, each player's hand consists of eight cards, including four face down cards dealt to each player and four cards in a common area, common to all of the players.

The lottery-style game may be played simultaneously with the poker-style game. The lottery-style game utilizes a second pot, which may be called a jackpot, into which the players place wagers. Prior to each deal, all players wishing to play in that particular deal may make an ante wager into the second pot prior to the dealer dealing any card. The ante wager is the same for all players, and may be a fixed amount for each deal, may increase with successive deals or after a predetermined number of successive deals, may depend upon the number of players at the table, or may otherwise be set by rule, dealer, casino, house, sponsor, or by agreement of the players. In the course of any deal, no additional wagers are placed in the second pot.

The lottery-style game is won by any player who, at the end of any deal, has not folded his or her hand, and whose hand can be identified as a jackpot hand according to a predetermined jackpot standard. The predetermined jackpot standard may comprise a relatively small number of low-probability hands such that jackpot hands are infrequent or difficult to obtain. In the event that no player has a jackpot hand at the end of any particular deal, the second pot is preserved and carried forward to the next successive deal, making it a "progressive" pot. Further, in some embodiments, the second pot may comprise the pooled wagers made at multiple gaming tables or locales.

By way of example and not limitation, in an embodiment in which each player's hand consists of eight cards, the jackpot standard may be as follows, wherein "Ace" designates a playing card with an Ace, "10" designates a playing card having a value of ten points (e.g. Ten, Jack, Queen, or King), and "9" designates a playing card having a value of nine points:

| Hand | Award |
|---|---|
| Ace + Ace + Ace + 10 + 10 + 10 + 9 + 9 | 100% of second pot |
| Ace + 10 + 10 + 10 + 10 + 10 + 10 + 10 | 80% of second pot |
| Ace + Ace + 10 + 10 + 10 + 10 + 10 + 9 | 75% of second pot |

Alternative jackpot standards can be created and implemented for games using eight-card hands, and other jackpot standards can be created and implemented for games with hands having a number of cards other than eight. Additionally, in some embodiments, the awards for the jackpot standard may be reduced by a percentage of the second pot to be paid to the casino, house, or sponsor.

In one embodiment of the poker-style game, prior to the showdown the dealer may permit any player remaining in the game to designate his or her hand as either a qualifying hand or a predicted winning hand. At the time of the showdown, a qualifying hand is entitled to a portion of the total wagers in the first pot, provided that the winning hand at the showdown was not designated as a predicted winning hand. A qualifying hand represents a "back door" or shortcut to winning a portion of the pot where the player might not otherwise be able to win in a showdown according to the predetermined ranking standard established for that particular game. In the event that a predicted winning hand is the winning hand at the showdown according to the predetermined ranking standard established for that particular game, then a qualifying hand is either not entitled to any portion of the total wagers in the first pot or it is only entitled to a reduced portion of the total wagers in the first pot than it would be entitled to if the winning hand were not also a predicted winning hand. A predicted winning hand is thus a sort of insurance policy against players with qualifying hands attempting to achieve a shortcut to taking a portion of the game pot.

In embodiments where the dealer permits players to designate hands as qualifying or predicted winning hands, the designation may occur such that the players make their designations simultaneously and without knowing how other players are designating their hands. One way of achieving this is to allow each player to place a distinctive marker in a designated spot on the table or other game area, wherein a first side or face of the marker designates the player's hand as a qualifying hand or as a predicted winning hand, and a second side or face of the marker has no distinguishing information, such that when placed with the first side or face down on the table or playing surface, markers for qualifying hands appear identical to markers for predicted winning hands. Markers may be chips, cards, or other appropriate devices, and the dealer, casino, house, or sponsor may sell markers for a price or require a fee or toll for playing a marker, which fee may be paid directly to the house or may be included in the first pot. Further, in some embodiments, the dealer may permit only one player to designate his or her hand as a qualifying hand, which qualifying hand may be the first qualifying hand in time so designated as determined by the dealer. In such embodiments, the dealer, casino, house, or sponsor may use a device or apparatus other than a marker to allow players to designate hands as qualifying or winning hands, such as a mechanical or electronic system that can accurately determine the first player in time to designate a hand as a qualifying hand. As described above, the dealer may permit the qualifying hand or predicted winning hand designation to take place prior to the showdown. In some embodiments it may be desirable to require players to so designate their hands prior to all of the cards being dealt in order to speed up the pace of the game.

Players are not required to designate their hands as either qualifying or predicted winning hands. In some embodiments, a player may not be permitted to designate his or her hand as both a qualifying and a predicted winning hand, even though the player's hand may be eligible for both designations. In some embodiments, a player may remove a marker that he has played, provided that he has not removed his hand from the marker and the time for designating a person's hand as either a qualifying hand or a predicted winning hand has not expired. In other embodiments, players may be required to play a marker once it has been placed in play on the table or other playing surface, regardless of other circumstances.

In order for a player's hand to be designated as a qualifying hand, it must meet a qualifying standard. In some embodiments, the qualifying standard may comprise one or more low-probability hands such that the standard is difficult to meet. The reward for a qualifying hand may be commensurate with the relative difficulty of meeting the qualifying standard. By way of example and not limitation, in an embodiment where a player's hand consists of eight cards, the qualifying standard may require the player to have at least four cards each having a value of ten (e.g. Tens, Jacks, Queens, or Kings) plus an Ace, having a value of eleven. Alternatively, for a similar embodiment, the standard may require only that the value of all cards in the player's hand sum to fifty-one, or some other predetermined value, or the standard may require that the player have any number of cards that sum to fifty-one exactly, or some other predetermined value. Further, the game may be varied such that qualifying hands are entitled to win certain predetermined fractions of the first pot, and the number of permitted qualifying hands may be varied. In some embodiments, the dealer may levy a fine on a player who erroneously designates his or her hand as a qualifying hand without meeting the qualifying standard.

In some embodiments of the wagering game, the dealer may play a hand on behalf of a casino, house, or sponsor. In some of these embodiments, the first pot is not used, and each player plays his or her hand against the house. In one exemplary form of this embodiment, each player would first place an ante wager in a predetermined amount fixed by the house. The dealer would then deal two cards face down to each player, and two cards face up in a common area. Each player would then place a second wager to continue playing, or fold his or her hand. Provided that at least one player has made the second wager, the dealer would then deal two additional cards face down to each remaining player, and two additional cards face up in the common area. Each player would then place a third wager to continue playing, or fold his or her hand. Provided that at least one player has made the third wager, the dealer would then deal four cards face up to himself or herself, and all remaining players would reveal the four face down cards dealt to him or her in the course of the deal. Each player's hand, including the dealer, consists of the four cards dealt to him or her in addition to the four cards in the common area. In this embodiment, if the dealer's hand beats a player's hand according to a predetermined ranking standard, then the player's ante, second, and third wagers are lost, or paid to the house. If the dealer's hand does not meet a minimum threshold, such as having at least one pair of Jacks, then the house may pay even money for each player's ante wager, and the second and third wagers may be pushed. If the dealer's hand does meet the minimum threshold but does not beat a player's hand, then that players wagers may be paid according to a predetermined schedule. In one exemplary form of such a schedule, if a player's hand comprises three of a kind or a lesser ranking hand, then the house may pay the ante wager at even money and push the second and third wagers. If a player's hand comprises a straight or greater ranking hand, then the house may pay the player's second and third wagers at even money and pay the ante wager as follows:

| Hand | Ante Wager Paid At |
|---|---|
| Straight | 2-1 |
| Flush | 3-1 |
| Full House | 5-1 |
| Four of a Kind | 25-1 |
| Straight Flush | 100-1 |
| Royal Flush | 200-1 |

This embodiment is only an example and is not intended to limit the possible variations for resolving or paying player hands against a dealer's hand.

In another embodiment where the dealer plays a hand on behalf of a house or sponsor, the lottery-style game may also be played simultaneously with the poker-style game. In a variation of this lottery-style game, instead of achieving hands whose card point totals add to eighty-one, players may be paid according to the number of Eight and Ace pairs in their hands. In this embodiment, the house may pay lottery or jackpot wagers according to the following exemplary schedule:

| No. of Eight-Ace Pairs | Jackpot Wager Paid At |
|---|---|
| One | 3-1 |
| Two | 5-1 |
| Three | 25-1 |
| Three or Four Suited | Jackpot |

In all embodiments in which a lottery-style game or jackpot is employed, it may be desirable for the house or sponsor to provide "seed" money to the jackpot immediately after it is won in order to provide a sufficient reward to a jackpot winner who wins in close succession to a previous jackpot winner. In such a case, the house or sponsor may be repaid a fraction of players' jackpot wagers until the seed money is repaid, at which time the players' jackpot wagers are entirely pooled in the jackpot.

While the invention has been described in connection with some exemplary embodiments, these embodiments are not limiting and are not necessarily exclusive of each other, and it is contemplated that particular features of various embodiments may be omitted or combined for use with features of other embodiments while remaining within the scope of the invention.

I claim:

1. A computer-based method for operating a wagering game, the method comprising:

operating a computer adapted for interfacing with a user, permitting the user to participate in the wagering game, the computer programmed with computer-executable instructions for:

(a) providing at least one deck of playing cards;

(b) receiving a first ante wager from a set of at least two players of the wagering game for a first pot, the set of at least two players including the user;

(c) receiving a second ante wager from at least a subset of the set of at least two players for a second pot;

(d) dealing two face down cards to each player of the set of at least two players and two face up cards in a common area;

(e) in a first wager round, permitting the user, via the computer, to place or call a wager into the first pot based on a predetermined player order or to discontinue participating in the game;

(f) dealing an additional face down card to each player of the set of at least two players that did not opt to discontinue participating and an additional face up card in the common area;

(g) if the user did not opt to discontinue participating, in an additional wager round, permitting the user, via the computer, to place or call a wager into the first pot based on a predetermined player order or to discontinue participating in the game;

(h) repeating steps (f) and (g) until a playing hand for each player of the set of at least two players that did not discontinue participating is composed of the respective player's four face down cards and the four face up cards in the common area;

(i) permitting the user of the computer to designate (i) that his or her playing hand is a qualifying hand according to a qualifying standard or (ii) that his or her playing hand is a predicted winning hand;

(j) resolving playing hands of the players of the set of at least two players that did not discontinue participating by rank according to a predetermined ranking standard to determine a winning hand;

(k) identifying whether the winning hand is designated as a predicted winning hand;

(l) awarding at least a portion of the wagers in the first pot (i) solely to the player having the winning hand if the winning hand has also been identified as a designated predicted winning hand, (ii) solely to the player having the winning hand where no other player has a qualifying hand, or (iii) in a predetermined portion to one or more players each having a qualifying hand, which was also designated as a qualifying hand, and the remainder to the player having the winning hand, where the winning hand was not designated as a predicted winning hand;

(m) identifying any jackpot hands according to a predetermined jackpot standard; and (n) awarding at least a portion of the wagers in the second pot to the jackpot hands according to the predetermined jackpot standard.

2. The method of claim 1, wherein the predetermined jackpot standard includes having a hand with a value of eighty-one points.

3. The method of claim 1, wherein the predetermined jackpot standard includes having a hand with one or more Eights and one or more Aces.

4. The method of claim 1, wherein the qualifying standard includes having a hand comprising any combination of cards that has a value of fifty-one points.

5. The method of claim 1, wherein the qualifying standard includes having a hand comprising any combination of cards that has a value of fifty-one or more points.

6. The method of claim 1, wherein one or more cards are dealt subsequent to permitting each of the players to designate that his or her playing hand is a qualifying hand according to a qualifying standard or that his or her playing hand is a predicted winning hand.

* * * * *